United States Patent [19]

Munyon

[11] 4,172,419

[45] Oct. 30, 1979

[54] PRE-LINKED STAMP CONSTRUCTION

[76] Inventor: Gary D. Munyon, 1836 Madison Ct., Concord, Calif. 94521

[21] Appl. No.: 857,302

[22] Filed: Dec. 5, 1977

[51] Int. Cl.[2] ..... B41K 1/02

[52] U.S. Cl. ..... 101/379; 101/368; 101/405; 101/327; 101/125

[58] Field of Search ..... 400/460, 460.1, 460.2; 401/170; 101/368, 125, 379, 380, 327, 405, 406

[56] References Cited

U.S. PATENT DOCUMENTS

| | | | |
|---|---|---|---|
| 2,900,902 | 8/1959 | Becker | 101/327 |
| 3,158,094 | 11/1964 | Harris et al. | 101/327 |
| 3,478,682 | 11/1969 | Funahashi | 101/368 |
| 3,886,863 | 6/1975 | Carabott | 101/125 |
| 3,952,653 | 4/1976 | McFarland | 101/368 |
| 4,022,127 | 5/1977 | Carlsson | 101/327 |

*Primary Examiner*—William Pieprz

[57] ABSTRACT

A pre-inked stamp device comprising a holder or mount and a die, said mount comprising a shell, a stamp core reciprocally movable relative to said shell, and a handle affixed to said core for reciprocally moving said core; the improvement wherein said shell and core are formed with complementary elongated ribs that contact and guide the core within said shell during relative reciprocal movement.

4 Claims, 5 Drawing Figures

PRE-LINKED STAMP CONSTRUCTION

SUMMARY OF THE INVENTION

This invention is directed to an improvement in and the construction of a holder or mount for a pre-inked or porous stamp and comprising an outer shell and a stamp core reciprocally mounted therein. The improvement of this invention relates to the provision of complementary elongated ribs formed on both the shell and core which contact and guide the core within the shell during relative reciprocal movement.

One object of the present invention is to provide a preinked stamp construction having a stamp core which moves with relative ease within an outer shell during long periods of use. Another object is to increase the normal wear life pre-inked stamps, while simultaneously improving the quality of impressions made with the stamp.

Other objects of this invention will become apparent in view of the following detailed description and the accompanying drawings.

DESCRIPTION OF THE DRAWINGS

In the drawings, forming a part of the application, and in which like parts are identified by like reference numerals:

Referring to FIG. 1 in particular, there is illustrated a preferred embodiment of the invention in a pre-inked or porous stamp having a mount that essentially comprises a shell 10, a stamp core 11 and a handle 12. Shell 10 is formed with a cavity having a substantially rectangular shape defined by four interior side walls 13, 14, 15 and 16 and a top wall 17 having a collar 18 that defines a central opening therethrough. Side walls 13, 14, 15 and 16 are preferably formed with a downward and outward taper to enhance the manufacture by molding processes. More importantly, however, the interior walls are integrally formed with elongated ribs 19*a*–19*h*, each rib having parallel contact surfaces which also parallel the central opening through collar 18.

Figure 1:
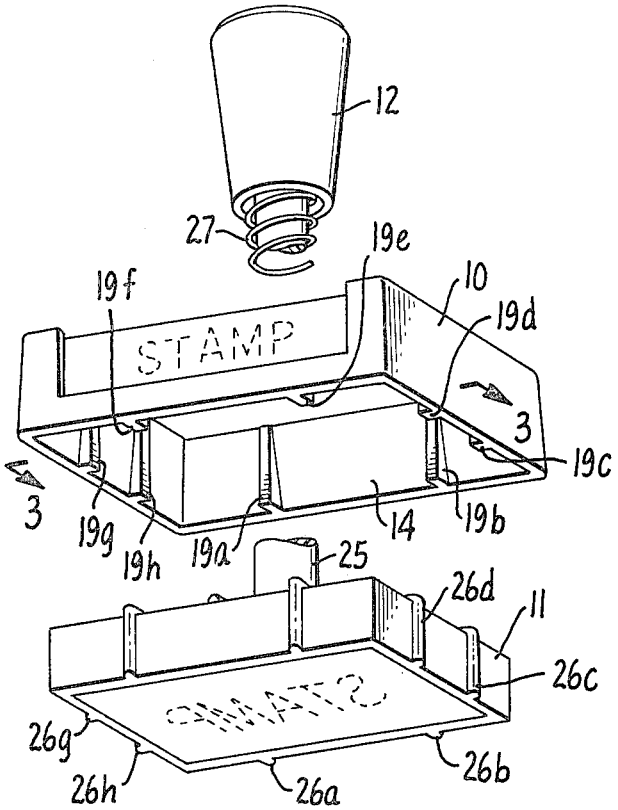
FIG. 1 is a perspective view of a preferred embodiment of the invention in a pre-inked or porous stamp construction, parts thereof being shown in an exploded relationship.
Figure 2:
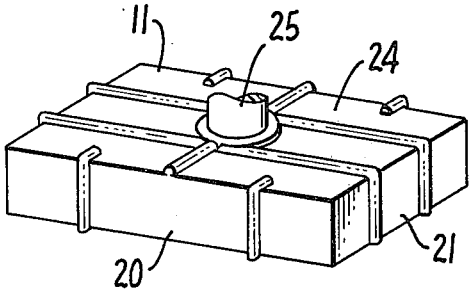
FIG. 2 is a perspective and detailed view of the stamp core.
Figure 3:
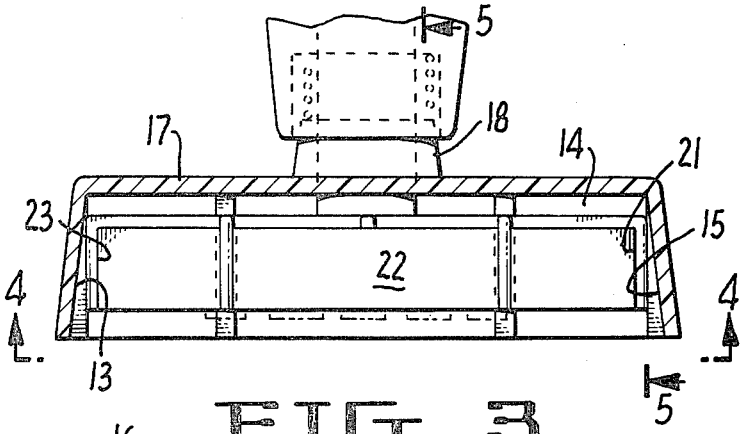
FIG. 3 is a vertical section of the stamp shell taken on lines 3—3 of FIG. 1 but illustrating the parts in assembly.
Figure 4:
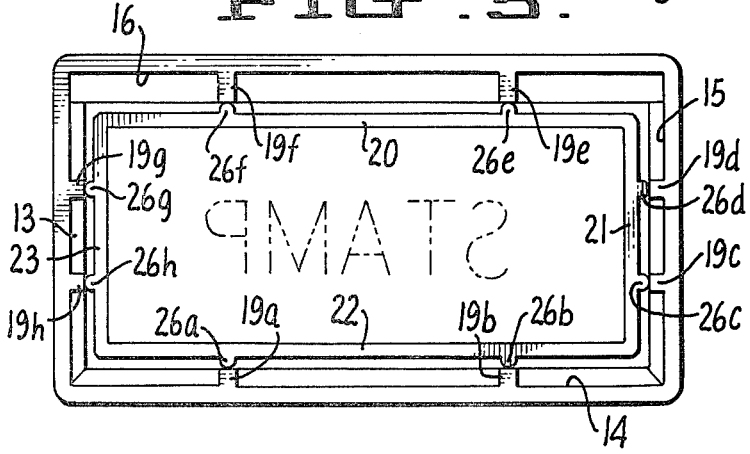
FIG. 4 is a bottom plan view of the pre-inked stamp taken on lines 4—4 of FIG. 3.

Stamp core 11 is mounted within the cavity of shell 10 for relative reciprocal movement, as shown in FIG. 3. Core 11 is formed with a substantially rectangular exterior defined by four exterior side walls 20, 21, 22 and 23 and an upper wall 24 from which there extends handle support shaft 25. A plurality of contact ribs 26*a*–26*h* are formed on the exterior side walls, a pair of such ribs being formed on each exterior side wall aligned with and slidably engageable with an associated pair of ribs on an interior side wall of shell 10. Thus, the ribs of the shell and stamp core serve to contact each other and guide the core within the shell during relative reciprocal movement. The elongated ribs formed on the exterior side walls of the stamp core are preferably rounded to reduce the area of frictional contact with the ribs of the shell and thereby enhance smoothness of reciprocal movement during a stamping operation.

Figure 5:
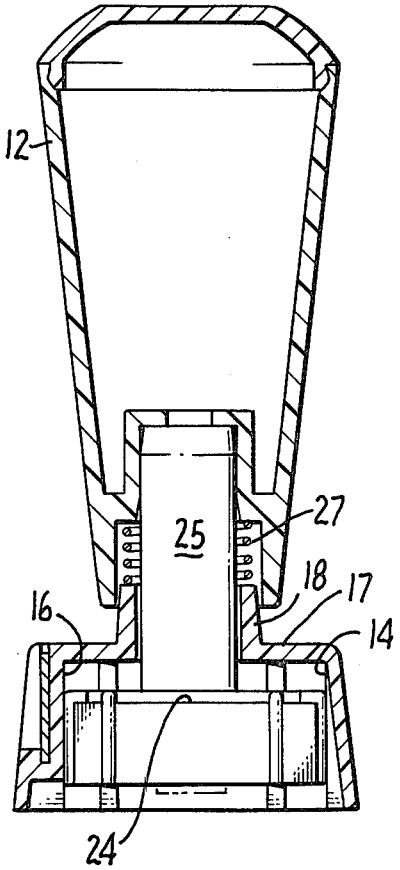
FIG. 5 is a vertical section taken on the broken line 5—5 of FIG. 3.

Referring to FIG. 5, handle 12 is secured to the upper end of handle shaft 25 with a spring 27 lodged in a recess formed in the handle and bearing against the upper end of collar 18. In operation, spring 27 serves to bias and lift the stamp core within shell 10 following each manual actuation.

Although a preferred embodiment of the invention has been illustrated and described, various modifications and changes may be made without departing from the spirit of the invention or the scope of the appended claims, and each of such modifications and changes is contemplated.

What is claimed is:

1. A mount for pre-inked stamps including a shell having a cavity, a stamp core mounted within the cavity of said shell for relative reciprocal movement therein, and a handle affixed to said stamp core for reciprocally moving said stamp core within said shell; the improvement wherein the interior walls of said shell and the exterior walls of said stamp core are formed with complementary elongated ribs that project generally normally from said walls, said ribs contacting each other and guiding the stamp core within the cavity of said shell during relative reciprocal movement.

2. The mount for pre-inked stamps of claim 1, the cavity of said shell having a substantially rectangular shape defined by four interior side walls, a pair of ribs being formed on each interior side wall; said stamp core having a substantially rectangular exterior defined by four exterior side walls, a pair of ribs being formed on each exterior side wall, the pair of ribs on each exterior side wall being aligned with and slidably engageable with an associated pair of ribs on each interior side wall.

3. The mount for pre-inked stamps of claim 1, said shell comprising four interior side walls and a top wall, said top wall having a central opening therethrough, said stamp core comprising four exterior side walls and a handle support, said handle support projecting through the central opening in the top wall of said shell.

4. The mount for pre-inked stamps of claim 1, the ribs of said stamp core being rounded and formed integrally with the stamp core.

* * * * *

UNITED STATES PATENT AND TRADEMARK OFFICE

CERTIFICATE OF CORRECTION

PATENT NO. : 4,172,419

DATED : October 30, 1979

INVENTOR(S) : Gary D. Munyon

It is certified that error appears in the above-identified patent and that said Letters Patent are hereby corrected as shown below:

In the Heading the word "Pre-Linked" should read -- Pre-Inked --.

Column 1, line 14, "preinked" should read -- pre-inked --.

Signed and Sealed this

*Twelfth* Day of *February 1980*

[SEAL]

*Attest:*

SIDNEY A. DIAMOND

*Attesting Officer*

*Commissioner of Patents and Trademarks*